US008910818B2

(12) United States Patent
Heiml

(10) Patent No.: US 8,910,818 B2
(45) Date of Patent: Dec. 16, 2014

(54) UNIVERSAL CLOSURE DEVICE

(75) Inventor: Roland Heiml, Voecklamarkt (AT)

(73) Assignee: STIWA Holding GmbH, Attnang-Puchheim (AT)

( * ) Notice: Subject to any disclaimer, the term of this patent is extended or adjusted under 35 U.S.C. 154(b) by 0 days.

(21) Appl. No.: 13/980,371

(22) PCT Filed: Jan. 18, 2012

(86) PCT No.: PCT/AT2012/050009

§ 371 (c)(1),
(2), (4) Date: Sep. 11, 2013

(87) PCT Pub. No.: WO2012/097396

PCT Pub. Date: Jul. 26, 2012

(65) Prior Publication Data

US 2014/0001184 A1 Jan. 2, 2014

(30) Foreign Application Priority Data

Jan. 19, 2011 (DE) ..... 10 2011 000 216

(51) Int. Cl.
*B65D 39/00* (2006.01)
*B01L 3/00* (2006.01)
*B65D 39/04* (2006.01)

(52) U.S. Cl.
CPC ..... *B65D 39/0052* (2013.01); *B01L 3/50825* (2013.01); *B65D 39/04* (2013.01); *B01L 2200/023* (2013.01); *B65D 2539/003* (2013.01); *B65D 2539/005* (2013.01)
USPC ..... 220/287; 220/787; 220/789; 220/800; 220/801; 215/294; 215/296; 215/355

(58) Field of Classification Search
CPC ..... B65D 39/00; B65D 39/04; B65D 39/16
USPC ..... 220/287, 787, 289, 800, 801, DIG. 19; 215/294, 296, 355
See application file for complete search history.

(56) References Cited

U.S. PATENT DOCUMENTS 4,553,567 A 11/1985 Telander
4,801,040 A * 1/1989 Kraus ..... 220/787

(Continued)

FOREIGN PATENT DOCUMENTS

CH 320 255 A 3/1957
DE 958 989 C 2/1957

(Continued)

OTHER PUBLICATIONS

International Search Report of PCT/AT2012/050009, dated May 14, 2012.

(Continued)

*Primary Examiner* — Elizabeth Volz
(74) *Attorney, Agent, or Firm* — Collard & Roe, P.C.

(57) ABSTRACT

The invention relates to a universal closure device (1) for openings (2) of sample containers (3) having different cross-sections (4). The closure device (1) comprises a shaft part (6) extending in the direction of a longitudinal axis (5) and a plurality of sealing elements (12, 16), which are disposed in the region of an outer surface (9) of the shaft part (6) and are intended for applying to an inner lateral surface (11) of the sample container (3) to be closed, wherein said lateral surface faces the longitudinal axis (5). The sealing elements (12, 16) arranged on the shaft part (6) are arranged in succession in a circumferential plane and in the circumferential direction of the shaft part (6). At least one supporting element (31, 33) is arranged and extends between the sealing element (12, 16) and the outer surface (9) of the shaft part (6).

17 Claims, 3 Drawing Sheets

(56) References Cited

U.S. PATENT DOCUMENTS

| | | | | | |
|---|---|---|---|---|---|
| 5,071,022 | A | * | 12/1991 | Sick | 220/789 |
| 5,496,141 | A | | 3/1996 | Popsys | |
| 2004/0115096 | A1 | | 6/2004 | Itoh | |

FOREIGN PATENT DOCUMENTS

| | | | | | |
|---|---|---|---|---|---|
| DE | 31 08 225 | A1 | | 9/1982 | |
| DE | 39 15 268 | C1 | | 12/1990 | |
| DE | 39 39 092 | A1 | | 5/1991 | |
| DE | 44 17 998 | A1 | | 11/1994 | |
| GB | 763 212 | A | | 12/1956 | |
| GB | 943 533 | A | | 12/1963 | |
| GB | 1 111 656 | A | | 5/1968 | |
| GB | 2 278 112 | A | | 11/1994 | |
| WO | WO 98/21109 | A1 | | 5/1998 | |
| WO | WO 2007/068011 | A1 | | 6/2007 | |
| WO | WO2007068011 | | * | 6/2007 | B65D 39/00 |

OTHER PUBLICATIONS

International Preliminary Report on Patentability of PCT/AT2012/050009, dated Jul. 23, 2013.

* cited by examiner

UNIVERSAL CLOSURE DEVICE

CROSS REFERENCE TO RELATED APPLICATIONS

This application is the National Stage of PCT/AT2012/050009 filed on Jan. 18, 2012 which claims priority under 35 U.S.C. §119 of German Application No. 10 2011 000 216.2 filed on Jan. 19, 2011, the disclosure of which is incorporated by reference. The international application under PCT article 21(2) was not published in English.

The invention relates to a universal closure device for openings of sample containers having different cross-sections.

A universal closure device is known from WO 2007/068011 A1 which can be inserted into openings of sample containers having different cross-sections. The closure device comprises a shaft part extending in the direction of a longitudinal axis with end sections spaced apart from one another in the direction of the longitudinal axis and a plurality of sealing elements arranged in the area of the outer surface of the shaft for placing against an inner, preferably approximately cylindrical casing surface turned towards the longitudinal axis of the sample container to be closed as well as a head part. On the shaft part on the side turned away from the head part a plurality of first sealing elements arranged in series and separate from one another are arranged in circumferential direction in a circumferential planet. The first sealing elements are arranged in a starting position located outside the opening and touch one another or overlap at least in some parts in a closure position inserted into the opening, in order to achieve at least a fluid-tight closure. The disadvantage of this was it was not possible to achieve a perfect mounting of the closure stopper in the inserted position in the sample container in all application cases.

From DE 44 17 998 A1 and GB 2 278 112 A a closure stopper is known with a part for inserting into an opening, such as for example a threaded bore, which comprises a shaft part and arranged thereon said radially projecting projections. The two projections are arranged spaced apart from one another in the longitudinal direction of the shaft part. The outer end edges of the projections are circular relative to the axis of the shaft part, apart from two intermediate spaces which are opposite one another. The shaft part tapers to the rear in the direction of the head part. In this way the projections can turn down in a compact manner so that the stopper fits into openings with different diameters. The projection with the larger external dimension is configured to be discontinuous around the body. In this way the projection can deform further relative to the ribs without this interruption. The intermediate space between the projections is selected so that in the case of an irregular opening the gap between the projections is not too big in order to ensure that at least a portion of the projections contacts the wall of the opening to the closed. The gap between two projections can be configured to narrow inwardly. The gap defined between two projections is shaped so that when the projections are turned to the rear the adjacent edges of the projections do not touch one another. This ensures that adjacent projections when turning to the rear do not lie on top of one another so that it is possible to adjust to the smallest possible opening.

DE 31 08 225 A1 describes a screw body for protecting tubes with a connecting thread or the like from internal dirt prior to their installation. In this case the screw body is provided with bendable segments for thread engagement with which they push themselves like a stopper into the thread openings of the tubes and can be tightened by a short rotation with their head sealing surface. On the shaft part of the screw body segments are arranged on parallel circles. The individual segments are provided with segment gaps to form individual segment sections which can adjust on pressing the screw body into the nut thread without difficulty to the nut thread and with greater or lesser twisting over their entire length can enter individually into the threads of the nut thread. It has proved to be advantageous for this purpose to make the segment gaps as large as the length of the segment sections or sectors. The segment sections or sectors can be formed by circle groups of two segments extending over 90° with 90° gaps arranged in between. The circle groups adjacent in the longitudinal direction of the shaft part are offset relative to one another so that the whole circumference is filled with segments. Another configuration of the bendable segment is selected such that the latter is arranged along a helical line with the thread type and thread height of the connecting thread on the shaft part of the helical body.

U.S. Pat. No. 4,553,567 A describes a protective cap for inserting into the threaded ends of cylindrical components, such as tubes for example. On the shaft part of the protective cap distributed around the circumference a plurality of rib elements are arranged in series and separate from one another. Between the individual segment-like ribs arranged in series in circumferential direction an intermediate space is provided by means of which the latter are arranged spaced apart from one another circumferentially. When inserting the closure stopper the latter engage with the threads and form holding elements there to prevent sliding out unintentionally.

The different closure devices according to GB 1 111 656 A comprise a shaft with a closed end and on the opposite side a head part for handling the closure device. In order to close different cross-sections of sample containers, a plurality of sealing elements running over the circumference are arranged in the direction of the longitudinal axis on the shaft part and spaced apart from one another. The latter have different external dimensions from one another, wherein at least one of the sealing elements forms a corresponding seal of the opening of the sample container in its inserted state. The individual sealing elements are in the form of sealing lips running over the circumference. However, it was not possible to achieve a satisfactory closure of sample containers with different openings widths in all application cases.

From DE 39 39 092 A1 a closure body made from an elastic material, in particular plastic, is known for inserting into the threads of housings. In this case the latter has a preferably cylindrical part on which on the circumferential side at least two circumferential radially directed webs are provided for connecting with the threads. At one end of the cylindrical part a flange-like head part is provided for fitting on the end face of a housing wall delimiting the thread bore. The radially directed webs have an external diameter corresponding almost to the external diameter of the thread and are arranged relative to one another at a mutual distance, which corresponds to the single or whole number multiple of the thread pitch in addition to at least approximately half of the thread pitch. In this way a mutual pretensioning is achieved within the thread pitch and in this way a good fit of the closure body is achieved. The radially directed webs can also have a helical configuration according to the course of the thread pitch and at the ends projecting to one another in the direction of the longitudinal axis can be arranged to be offset to one another. In this case a single web-like holding element is formed continuously over the circumference.

GB 943 533 A describes a closure device in the form of a spout for inserting into bottle openings with an approximately cylindrical shaft part and a head part. Sealing lips which are spaced apart from one another in the direction of the longitudinal axis over the length are arranged on the shaft part which have different external dimensions from one another. It was not possible in all cases to achieve the adequate closure of sample containers with different opening widths.

The universal closure device according to WO 1998/21109 A1 is used for closing sample containers with different opening cross sections, with a narrowing shaft part set back in the direction of the longitudinal axis and a head part. On the set back shaft elements continuous annular sealing lips are arranged with a cross section decreasing from the head part. The sealing lip turned away from the head part and arranged on a shoulder is used when fitting into an opening with a smaller diameter than the head part and thus fits on the end face side of the sample container. The head part comprises two tubular components spaced apart from one another in radial direction, between which reinforcing ribs extend. The outer circumferential area of the outermost tubular component has a knurled surface to improve the grip. To vent the air that is compressed when inserting the closure device into the sample container the latter has an opening arranged in an end face wall. The disadvantage of this closure device is the large structural length for sealing different cross-sectional openings of the sample container.

A stopper according to DE 958 989 C is used for insertion in tubes, bottles or the like and comprises a head part and a shaft with sealing elements arranged thereon. The individual sealing elements are arranged spaced apart from one another in the longitudinal direction of the shaft and are configured as circular sealing sleeves which are designed to be continuous over the circumference. In this case the sealing sleeves have a smaller material thickness on their outer circumference than in the vicinity of the shaft. In this case an adequate closure of sample containers with different opening widths could not be achieved in all application cases.

Another closure device according to CH 320 255 A comprises a disc-like head part and a connecting shaft part. On the outer surface of the shaft part in the direction of the longitudinal axis of the shaft annular lips are arranged which are spaced apart from another over the outer circumference, which are provided for bearing against the opening of the sample container to be closed. The seal is provided by the elastic deformation of the annular lips during insertion into the opening. This insertion movement can be facilitated by inclined surfaces, as seen in axial cross-section. The reliable closure of openings with different cross-sections could not be achieved in all cases of application.

In previously known closure devices it was usually the case that to reclose the opening afterwards a closure device was used which was selected according to the size of the opening to be closed. In this case the latter comprises on the shaft part in the direction of its longitudinal axis sealing elements which are spaced apart from one another and formed continuously over the circumference, which when inserted into the opening to be closed form the sealing closure. Particularly in the area of automated sample analysis this requires high logistical outlay.

The underlying objective of the invention is to create a universal closure device for openings of sample containers having different cross-sections, which within predeterminable dimensional limits ensure secure fixing in the sample container and the closure device in this position prevents the escape of fluid contained in the sample container.

Said objective of the invention is achieved in that between the sealing element and the outer surface of the shaft part at least one supporting element is arranged extending in between.

The advantage achieved by the features described herein is that the reliable fixing of the universal closure device can be achieved in all cross-sectional dimensions or diameter ranges of the sample container. Particularly with average diameters of the openings there is now an approximately radially directed pressing force of the sealing elements towards the inner wall of the sample container, whereby the closure device is also reliably prevented from being pushed out in this operating state. In this way the free bending length of the sealing elements is shortened so far that in this way a relative position of the sealing elements or the sample container is achieved, in which the radially acting pressure force predominates and in this way either no or only a small axial force is produced by the deformed sealing elements. Furthermore, the supporting elements also have the advantage that in sample containers with a relatively large opening cross section the rigidity of the individual sealing elements is increased further in order in this way to increase the resistance to deformation and thereby the established holding force.

A further configuration with the supporting element arranged on the side of the sealing element turned towards a head part of the shaft part is also advantageous as in this way the supporting element is charged in the inserted state by a pressing force and in an operating position in sample containers with a relatively small opening cross section it is possible to achieve a secure arrangement on top of one another of the relatively displaced sealing elements.

In the embodiment in which the supporting element extends in radial direction approximately to a middle between the outer surface of the shaft part and an outer edge area of the sealing element it is an advantage that in this way the built up pressure can be determined exactly and the associated holding force of the universal closure device can be determined right in the middle diameter range.

A further embodiment in which the supporting element is configured to be rib-like or web-like and includes a cross-sectional reduction is also advantageous, as thus depending on the cross-section of the supporting element with regard to the reduced cross-section for larger deformations a predetermined bending point or a predetermined breaking point can be formed. In this way the optimum holding force can be achieved or determined for each closure process.

In another embodiment variant wherein the cross-sectional reduction is formed by a groove extending into the supporting element and groove surfaces delimiting the groove laterally are inclined relative to the outer surface of the supporting element, a directed separation of the supporting element and thereby an overlapping position of the supporting element parts is achieved, whereby with a stronger deformation of the sealing elements there is no hindrance to the deformation.

An embodiment in which the sealing elements arranged in series in circumferential direction are arranged immediately next to one another in a starting position located outside the opening and these sealing elements contact one another or at least overlap one another partly in a closed position when the device is inserted into the opening of the sample container in order to achieve a fluid-tight closure of the opening in this closed position is also advantageous, as here the sealing elements are arranged in series over the circumference of the shaft part of the closure device and by means of their separate arrangement during the insertion movement of the closure device a mutual relative displacement can take place between the immediately adjacent sealing elements. In this way it is possible on the one hand to close a plurality of openings having different cross-sectional dimensions with a single closure device and on the other hand to achieve a secure fit or adequate holding of the closure device in the closure position.

By means of the intermediate chamber formed in this way, even if the latter is only very small, a throughflow opening is created for air compressed during the closure process and the latter can escape from the inner chamber between the sample contents in the sample container and the inserted closure device. In this way also the closure device is prevented from being pushed out of the opening in an undesirable manner. Furthermore, in this way in the closed position at least a leak-proof or even fluid-tight closure of the opening is achieved by the sealing elements and if the sample container falls over the content of the sample is prevented from escaping, mainly if the latter is formed by a fluid, such as a body fluid, in particular blood or the cellular components thereof. Furthermore, also dirt or other particles are prevented from entering during the storage of the samples until the latter are destroyed.

A configuration is also advantageous in which first sealing elements arranged in series in the circumferential direction of the shaft part are arranged immediately adjacent to the end section that is turned away from the head part, as even during the insertion movement with a sealing closure relative to the casing surface of the sample container it is still possible for the compressed air to escape.

In the configuration in which second sealing elements arranged in series in the circumferential direction of the shaft part are arranged between first sealing elements and the head part, it is an advantage that a better relative fixing in position of the closure device can be ensured in the opening that is to be closed and in this way possible tilting and thereby possible leaking are prevented.

A further embodiment in which the sealing elements arranged in series in the circumferential direction are spaced apart from one another at least partly in a starting position located outside the opening is also advantageous as in this way an even more reliable passage of air between the individual sealing elements is ensured during the insertion movement.

By means of the configuration in which the sealing elements are formed by circular ring sections which extend preferably approximately over half the circumference of the shaft part it is possible for a closure device to be created that is simple to produce and which can be made of plastic by means of an injection molding process.

In another embodiment variant in which the sealing elements arranged in series in the circumferential direction are arranged starting from the shaft part in the direction of the head part respectively in a common, truncated cone-shaped widening casing surface and in which a taper angle formed by the sealing elements arranged in series in circumferential direction can be selected from a range with a lower limit of 70° and with an upper limit of 178°, the insertion movement of the closure device into the opening is facilitated and also the mutual, relative displacement between the individual sealing elements is supported.

A development is also advantageous in which at least one gap is formed between the sealing elements arranged in series in circumferential direction and arranged immediately adjacent one another, the gap extending from an edge area of the sealing elements in the direction of the shaft part, wherein the gap can extend continuously between the outer edge area to the outer surface of the shaft part, as thereby on the one hand the inherent rigidity of the sealing elements can be determined and on the other hand the possible overlap of the individual sealing elements arranged immediately next to one another in the closure or insertion position can be determined.

Lastly, by means of development in which end faces of the sealing elements which are turned towards one another and arranged adjacent to one another and which define the gap, are inclined relative to the longitudinal axis in a view perpendicular to the longitudinal axis, a sealing element is created which is easy to produce, for which depending on the extent or degree of deformation in the insertion or closure position a secure overlapping of the individual sealing elements in series in circumferential direction can still be achieved.

For a better understanding of the invention the latter is explained in more detail with reference to the following figures.

In a much simplified schematic representation:

Figure 1:
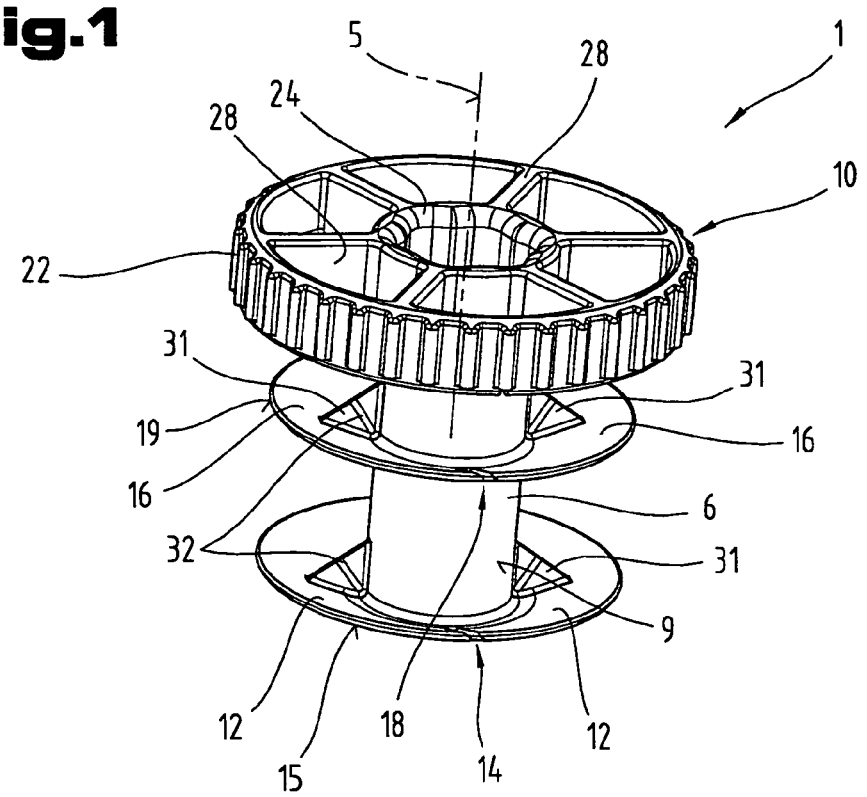
FIG. 1 shows a closure device according to the invention comprising a plurality of sealing elements, in a simplified figurative representation.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

All of the details relating to value ranges in the present description are defined such that the latter include any and all part ranges, e.g. a range of 1 to 10 means that all part ranges, starting from the lower limit of 1 to the upper limit 10 are included, i.e. the whole part range beginning with a lower limit of 1 or above and ending at an upper limit of 10 or less, e.g. 1 to 1.7, or 3.2 to 8.1 or 5.5 to 10.

FIGS. 1 to 4 show a universal closure device 1 for openings 2 of sample containers 3 having different cross-sections 4. In this case the universal closure device 1 can be inserted into different sample containers 3, whereby said sample containers 3 have different sized openings 2 with corresponding cross-sections 4.

In the case of circular round sample containers 3, as is the case for example in blood collection tubes or the like, the latter can have an inner cross-section or an internal diameter with a lower limit of 8 mm, preferably 11 mm and an upper limit of 18 mm, preferably 14 mm. Depending on the sample container 3 selected the same universal closure device 1 can always be used for closing the opening 2 regardless of the selected cross-section 4. The universal closure devices 1 according to the invention are used when the closure device usually comprising one sealing stopper and at least one pierceable sealing stopper for taking the sample is removed from or out of the opening 2 of the sample container and the universal closure device 1 is then used for closing the opening 2 for further storage. All of the closure devices 1 described in the following are used to ensure at least the leak-proof, in particular also fluid-tight closure of the opening 2 during the storage period of the sample. Therefore, using only a single closure device 1 for a plurality of different inner cross-sections 4 is advantageous, as regardless of the size of the opening 2 of the sample container 3 to be closed the same universal closure device 1 can be used within certain limits. The term leak-proof means here that the closure device 1 seals the opening 2 to the extent that between the sealing elements 12, 16 described in more detail below and/or between the sealing elements 12, 16 and an inner casing surface 11 of the sample container 3 delimiting the opening 2 very small capillary gaps remain open. This has the advantage that when joining together the closure device 1 and the sample container 3 the compressed air can escape. Otherwise in the case of a fully filled sample container 3 the stopper would jump straight out of the opening 2 again. Furthermore, in this way vapors that may form during storage over a long time period can also escape. However said capillary gaps are configured to be so small that aqueous liquids cannot pass through without pressurization because of the surface tension. If a sample container 3 is shaken or stood on its head it is highly likely that liquid may escape.

The closure device 1 shown here comprises a shaft part 6 extending in the direction of a longitudinal axis 5 with end areas 7, 8 spaced apart from one another in the direction of the longitudinal axis 5. The shaft part 6 also has an outer surface 9 between the two spaced apart end areas 7, 8. In the region of the first end area 7 the closure device 1 also comprises a head part 10 which is used for handling the closure device 1.

The sample container 3 comprises a preferably approximately cylindrical casing surface 11 in the region of its inner chamber on the side facing the longitudinal axis 5 at least in the region in which the closure device 1 is to be inserted.

A plurality of separate first sealing elements 12 are provided on the shaft part 6 in the exemplary embodiment shown here on the side facing away from the head part 10 in circumferential direction of the shaft part 6. The individual first sealing elements 12 are arranged in series circumferentially and preferably in the same plane. The first sealing elements 12 shown here are distributed over the circumference, preferably arranged directly adjacent to one another and can be formed for example by circular ring sections. In the present exemplary embodiment two first sealing elements 12 are provided in the same plane. In this case, as shown in a simplified form in FIGS. 1 and 2, the first sealing elements 12 can be arranged spaced apart from one another at least partly in a starting position outside the opening 2. The shaft part 6 comprises, as described briefly above, the two spaced apart end areas 7, 8, wherein in this exemplary embodiment shown here the first sealing elements 12 are arranged immediately adjacent to the end section 8 which is turned away from the head part 10.

Furthermore, the first sealing elements 12 starting from the shaft part 6 in the direction of the head part 10 can be arranged in a common, truncated cone-shaped widening casing surface. In this way a taper angle 13 formed by the first sealing elements 12 can be selected from a range with a lower limit of 70°, advantageously 90°, in particular 100°, preferably of 120° and with an upper limit of 178°, advantageously 170°, in particular 150°, preferably 140°.

Between the immediately adjacent first sealing elements 12 at least one first gap 14 is formed, wherein the gap 14 extends from an edge area 15 of the first sealing elements 12 turnable towards the inner casing surface 11 of the sample container in the direction of the shaft part 6. In this case it is also possible for the first gap 14 to extend continuously between the outer edge area 15 of the first sealing elements 12 to the outer surface 9 of the shaft part 6.

Furthermore the closure device 1 in addition to the first sealing elements 12 comprises additional sealing elements 16 which are also arranged on the shaft part 6. Said additional sealing elements 16 are arranged as viewed in the direction of the longitudinal axis 5 between the head part 10 and the first sealing elements 12 on the shaft part 6. In this case the additional sealing elements 16 can also be formed by circular ring sections, as described previously in relation to the first sealing elements. Likewise the additional sealing element 16 can be configured similarly to the first sealing elements 12 to widen from the shaft part 6 in the direction of the head part 10 in the form of a truncated cone, wherein a taper angle 17 formed by the additional sealing element 16 or sealing elements 16 can be selected from a range with a lower limit of 70°, preferably 90°, in particular 100°, preferably 120° and with an upper limit of 178°, preferably 170°, in particular 150°, preferably 140°.

Furthermore, it is also possible that in the additional sealing element 16 at least one further gap 18 penetrating the latter is provided and the additional gap 18 extends from the edge area 19 turned towards the inner casing surface 11 of the sample container 3 in the direction of the shaft part 6. In this case the additional gap 18 can also be formed extending continuously between the outer edge area 19 of the additional sealing element 16 up to the outer surface 9 of the shaft part 6. Furthermore, it can also be advantageous if at least one of the first and second gaps 14, 18 are arranged to be aligned with one another in the direction of the longitudinal axis 5, i.e. in series, in the area of the sealing elements 12, 16. In this case the gap 14, 18 between the immediately adjacent sealing elements 12 or 16 can have a width 20 with a lower limit of 0 mm and an upper limit of 1.5 mm. Similarly, it would also be possible for the width 20 of the gaps 14, 18 to be configured differently over its longitudinal extension, from the edge area 15 or 19, to the shaft part 6 or the outer surface 9. Regardless of this it would also be possible however that the width 20 of the gap or gaps 14, 18 is formed to decrease continuously over its longitudinal extension from the outer edge area 15, 19 of the sealing elements 12, 16 in the direction of the outer surface 9 of the shaft part 6.

When the closure device 1 is inserted into the opening 2 of the sample container 3 there is a mutual relative displacement of the individual sealing elements 12 and/or 16 relative to one another and the sealing elements 12, 16 separated from one another at least initially bear against one another in the area of the gaps 14, 18 or even overlap one another at least partly. These positions are then defined as the so-called working position.

Figure 3:
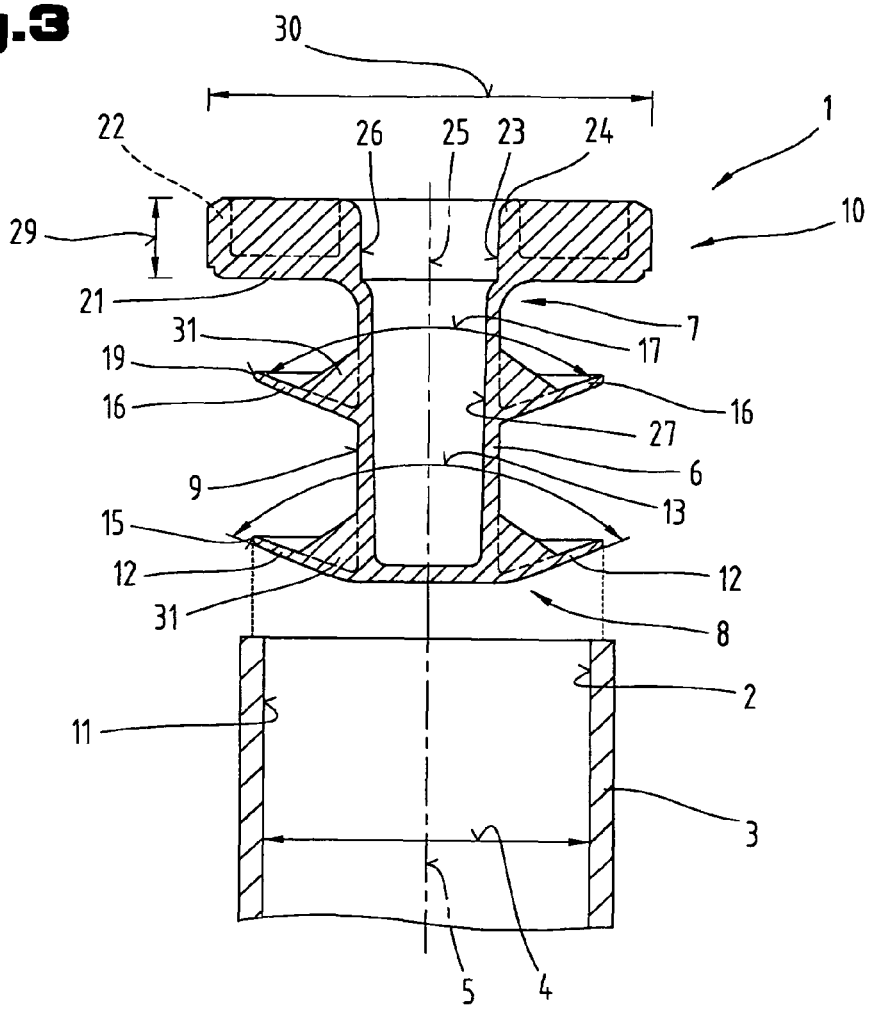
FIG. 3 shows the closure device according to FIGS. 1 and 2 prior to insertion into a sample container, in cross-sectional-view.
Figure 4:
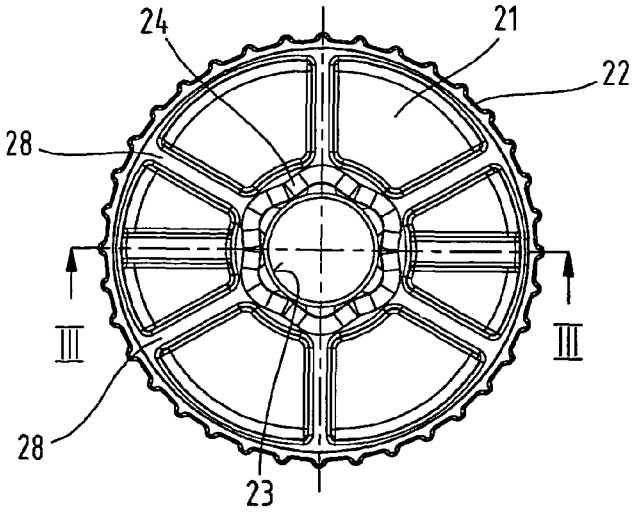
FIG. 4 shows the closure device according to FIGS. 1 to 3 in plan view.

As shown best from an overview of FIGS. 1, 3 and 4, the head part 10 comprises a disc-like base part 21 aligned perpendicular to the longitudinal axis 5, and a tubular edge part 22 projecting over the base part 21 in a direction facing away from the shaft part 6. The tubular edge part 22 is arranged on the outer circumference of the base part 21 and is preferably connected to the latter in one piece or is material boned. It is also possible to provide ribs and/or recesses on the outer circumference of the tubular edge part 22 to improve the grip of the closure device 1. Preferably, the ribs or webs or recesses run parallel to the longitudinal axis 5.

Furthermore, in the base part 21 in the area of the longitudinal axis 5 and centrally thereto a recess 23 can be arranged, whereby said recess 23 can extend in the direction of the longitudinal axis 5 at least partly into shaft part 6. Depending on the dimensions and material selected for the shaft part 6 the latter can be made from a solid material or can also be tubular. The latter should have at least a sufficient sealing effect (fluid-tight and/or gastight). In the case of a fluid-tight and/or gastight material or choice of dimensions of the shaft part 6 the sealing elements 12, 16 should be configured so that their outer edge area 15, 19 and the overlapping area in the section of the gaps 14, 18 provide a sealing effect together with the sample container 3.

Furthermore, it is possible that on the base part 21 a tubular shoulder 24 is provided, in particular is connected to the latter, the central axis 25 of which is aligned to be flush with the longitudinal axis 5 of the base part 21 or shoulder 6. In this way a central arrangement of the tubular shoulder 24 is achieved relative to the shaft part 6 or the recess 23 arranged in the base part 21. In this case the tubular shoulder 24 can be configured such that the latter is arranged in the circumferential part of the recess 23 in the base part 21. In this way the tubular shoulder 24 can have an internal inner cross-section which corresponds approximately or exactly to the internal cross-section of the recess 23 in the base part 21. If the tubular shoulder 24 is used for mounting in an automatic handling device, it is advantageous if the tubular shoulder 24 is delimited at least in part on an inner surface turned towards the longitudinal axis 5 by an approximately cylindrical first centering surface 26 and the central axis 25 of this centering surface 26 or the tubular shoulder 24 is aligned to be parallel and flush with the longitudinal axis 5. Furthermore however, the recess 23 can also be delimited by an approximately cylindrical additional centering surface 27, wherein its central axis 25 is also aligned to be parallel and flush with the longitudinal axis 5. In order to insert a centering mount or a centering bolt, not shown here in detail, into the tubular shoulder 24 or the recess 23 in the base part 21 it is advantageous if at least the centering surface 26 has a widening insertion surface turned away from the longitudinal axis, such as radius or a beveled edge for example.

To reinforce the base part 21 on the latter on the side turned away from the shaft part 6 at least one but preferably a plurality of ribs 28 can be provided. In this case the ribs 28 can be arranged continuously between the facing sides of the tubular edge part 22 and the tubular shoulder 24. Preferably however, the ribs 28 are aligned such that the latter extend radially from the tubular edge part 22 in the direction of the longitudinal axis 5, whereby an approximately central or star-like arrangement is achieved.

The height 29 of the tubular edge part 22, as viewed in the direction of the longitudinal axis 5 in relation to an outer cross-sectional dimension 30 of the head part 10 or the base part 21 in a plane perpendicular to the longitudinal axis 5, is selected from a range with a lower limit of 8%, advantageously 10%, in particular 12%, preferably 18%, and with an upper limit of 100%, advantageously 50%, in particular 30%, preferably 25%.

The shaft part 6 can be formed in the end area 8 facing away from the head part 10 approximately in a plane with the sealing elements 12 arranged on the shaft part 6, wherein the latter independently of this can have a closure which can be configured to be curved convexly and/or spherically and/or conically relative to the longitudinal axis 5 as viewed in axial cross-section. Furthermore however, the shaft part 6 can also project over the first sealing elements 12 to the side facing away from the head part 10. Depending on the configuration of the shaft end in its end area 8 the joining process of the closure device 1 into the opening 2 of the sample container 3 can be facilitated.

Furthermore, it is still possible that end faces 40, 41 of the sealing elements 12, 16, which are turned towards one another and arranged adjacent to one another and which define the gap 14, 18, are inclined relative to the longitudinal axis 5 in a view inclined perpendicular to the longitudinal axis 5. In this case inclined means that the end faces 40, 41 are aligned to be oblique to the surface of the sealing elements 12, 16 and thus form oblique surfaces in the form of guiding surfaces for the directed overlap of the sealing elements 12, 16 arranged immediately behind one another and adjacent to one another. This is shown best in FIG. 2.

Figure 2:
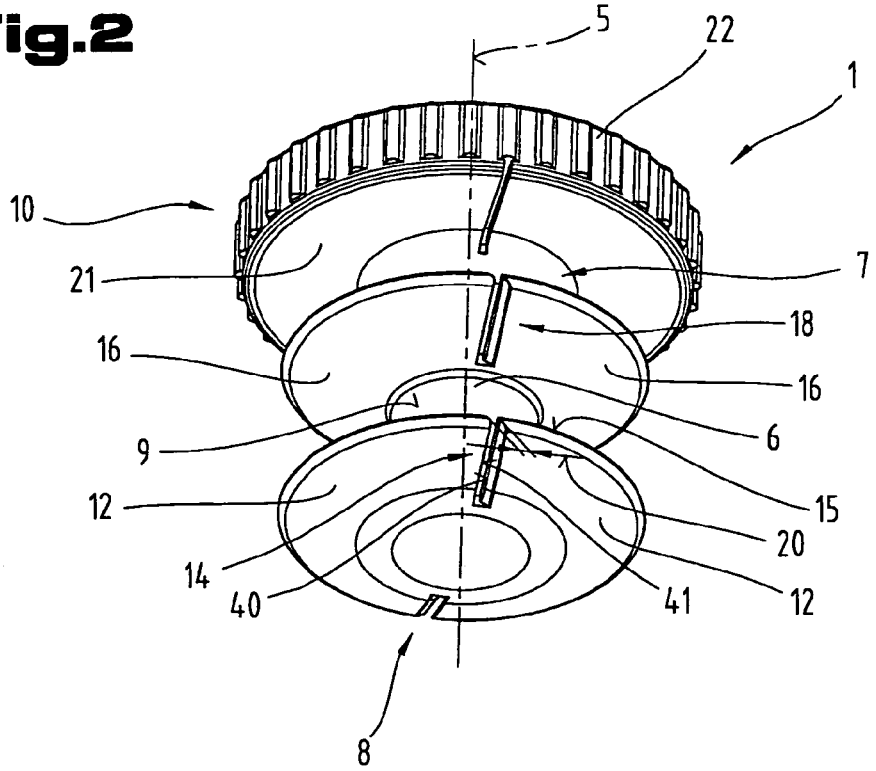
FIG. 2 shows the closure device according to FIG. 1, in a simplified figurative representation.

A shown best in an overview of FIGS. 1 to 3 in the exemplary embodiment shown here at least one supporting element 31 is arranged or provided extending between the first sealing elements 12 and, if the additional sealing elements 16 are provided, between the latter and the outer surface 9 of the shaft part 6.

In this case the supporting element 31 is preferably turned towards the end section 7 which also supports the head part 10 of the shaft part 6 and extends from the sealing elements 12 and/or 16 to the shaft part 6. The supporting element 31 is connected both to the sealing element or elements 12, 16 and to the shaft part, in particular is formed in one piece thereon. The supporting element 31 can also be arranged however on the side facing away therefrom. The supporting element or elements 31 shown here are configured to be rib-like and form a reinforcing element between the sealing element or elements 12, 16 and the shaft part 6. Furthermore, it is also shown here that the supporting element 31 extends as viewed in radial direction approximately to the middle or half the length between the outer surface 9 of the shaft part 6 and an outer edge area 15, 19 of the sealing element 12, 16. In this case it is possible, on the one hand to shorten the sealing element 12, 16 in its free bending length between the outer surface 9 of the shaft part 6 and the outer edge area 15, 19 and on the other hand to leave a certain residual radial distance as a free bending element.

Furthermore, it is also possible to provide the supporting element 31 with a cross-sectional reduction 32 in a section of its two rib faces. Said cross-sectional reduction 32 is described in more detail below. The cross-sectional reduction 32 should be used to determine the strength or rigidity of the supporting element 31 exactly. In this way the supporting element 31 can absorb a predefined pressure and/or traction in the direction of its longitudinal extension, i.e. in parallel direction to its side surfaces, wherein if said applied force is exceeded the supporting element 31 in the area of the cross-sectional reduction 32 loses its strength and either bends or is even severed. Said cross-sectional reduction 32 is used to form a predetermined breaking point or predetermined bending point.

As already described above the universal closure device 1 is intended for use with a plurality of different cross-sections of the sample containers 3. By providing additional supporting elements 31 it is possible to achieve, particularly with an average cross-section or diameter range of the sample container 1, which is approximately between 10 mm and 13 mm, in particular 11 mm to 12 mm, the perfect mounting or fixing of the universal closure device 1 relative to the sample container 3.

If the closure device 1 is inserted into a sample container 1 with a relatively large cross-section and a diameter of about 13 to 18 mm the sealing elements 12, 16 are only deformed slightly. This produces not only a leak-proof, in particular fluid-tight closure of the opening 2 of the sample container 3, but also a good holding or fixing of the closure device 1 by the sealing element 12, 16 on the sample container 3.

In sample containers 3 with a relatively small opening cross section, for example between 8 mm and 9 mm, the sealing elements 12, 16 are deformed to the extent that in the area of the facing ends of the sealing elements 12, 16 it causes the overlapping of the latter over a large area and the supporting element or elements 31 is/are at least deformed if not actually severed. The deformation can occur in the area of the cross-sectional reduction 32.

In the exemplary embodiment shown here the two sealing elements 12, 16 are configured as sections of a circular ring and extend approximately over half the circumference.

If the arrangement of the additional supporting elements 31 is omitted then on inserting the closure device 1 into the sample container 3 with an average opening size of 11 mm to 12 mm a deformation of the sealing elements 12 or 16 takes place, whereby the latter then form the taper angle 13 or 17 of about 90°. This means that the closure device 1 can be pushed automatically out of the opening 2 of the sample container 3 without assistance.

However if supporting elements 31 are provided they provide a reinforcement of the sealing elements 12, 16 up to the radial end area of the supporting elements 31 and then only a small part of the sealing element 12, 16 is deformed more strongly, whereby an approximately radially directed pressing force is formed with a small component in axial direction.

Figure 5:
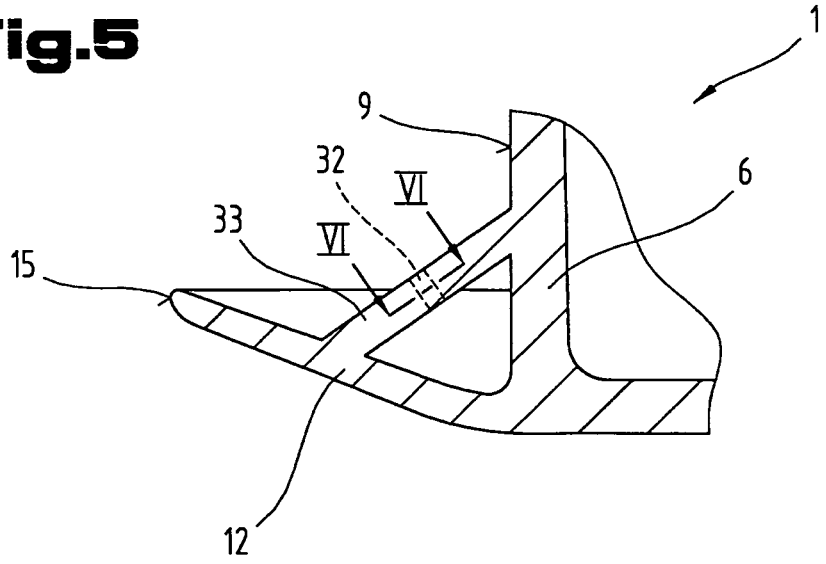
FIG. 5 shows a further possible configuration of a supporting element in cross-sectional view and in an enlarged view.

FIG. 5 shows a further and possibly independent embodiment of the closure device 1, in particular its supporting element 31 between the sealing element 12, 16 and the shaft part 6, wherein the same reference numerals and component names are used as for the preceding FIGS. 1 to 4. To avoid unnecessary repetition reference is made to the detailed description relating to the preceding FIGS. 1 to 4.

The supporting element 33 shown here is configured to be web-like and also extends as with the previously described supporting element 31 between the sealing element 12 or 16 and the outer surface 9 of the shaft part 6. Here too a fixed connection of the supporting element 33 is formed with the components of the closure device 1 connected to the supporting element 33 or 31. As the supporting element 33 shown here is configured rather to have a flat profile a flat space is formed in the direct connection area of the sealing element 12, 16 and the outer surface 9 of the shaft part 6. Otherwise the effect of the supporting element 33 shown here is similar to the previously described supporting element 31. Likewise the previously described cross-sectional reduction 32 can be provided in the form of one or more beads or grooves, as shown here in simplified form.

Figure 6:
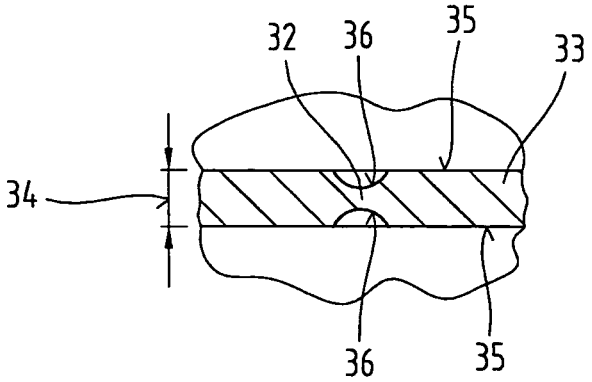
FIG. 6 shows a possible configuration of a cross-sectional reduction in the region of the supporting element, in cross-sectional view according to lines VI-VI in FIG. 5.

FIG. 6 shows a possible configuration of a cross-sectional reduction 32 on the supporting element 33 in cross section. The flat profile-like supporting element 33 has a thickness 34 in which from flat sides or an outer surface 35 of the supporting element 33 a groove-like depression 36 extends into the cross-section. Here it is shown that the groove-like depression 36 is provided on both sides in each of the outer surfaces 35 and the latter can also be arranged directly opposite one another. It would also be possible to arrange the groove-like depressions 36 to be offset relative to one another in the two outer surfaces 35. The cross-sectional reduction 32 is formed between the two groove-like depressions 36 with a smaller cross-sectional dimension than the thickness 34.

Figure 7:
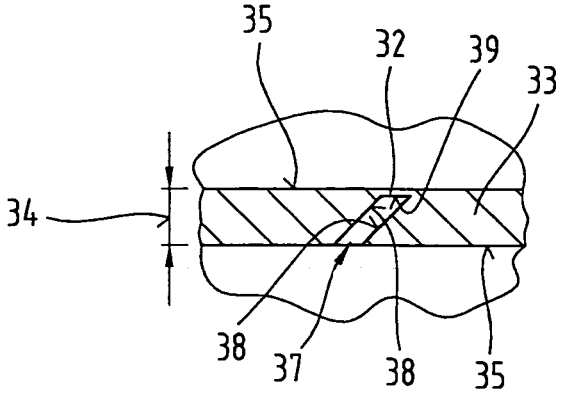
FIG. 7 shows another embodiment of a cross-sectional reduction in the region of the supporting element, in cross-sectional-view according to the lines VI-VI in FIG. 5.

FIG. 7 shows a further possible and independent configuration of a cross-sectional reduction 32 on one of the supporting elements, in the present case supporting element 33, in which the same component names and reference numerals are used as for the preceding FIGS. 1 to 6. To avoid unnecessary repetition reference is made to the detailed description relating to the preceding FIGS. 1 to 6.

The cross-sectional reduction 32 is formed in the supporting element 33 shown here by a groove 37 extending into the supporting element 33, wherein the groove 37 is formed by said laterally delimiting groove surfaces 38. The groove or the laterally delimiting groove surfaces 38 extend in an inclined direction relative to the outer surface 35 of the supporting element 33 into the latter. A groove base 39 is arranged spaced apart from the outer surface 35 of the supporting element 33, wherein the cross-sectional reduction 32 or the reduced cross-section of the supporting element 33 remains between the groove base 39 and said surface 35 by the remaining material or matter of the supporting element 33. By means of the inclined arrangement of the groove surfaces 38 under force loading by the schematically indicated pressing force "F" a shearing action occurs of the cross-sectional reduction 32 in the area of the reduced cross-section, whereby the two remaining part sections of the supporting element 33 are applied against the two groove surfaces 38 and also oblique sliding leads to a corresponding counter displacement of the part sections of the supporting element 33. In this way also in sample containers 3 with a small cross-section there can be a sufficient displacement of the sealing elements 12, 16 relative to the shaft part 6 or the sample container 3.

It should be mentioned that the cross-sectional reduction 32 in the previous different embodiments can be applied to all of the supporting elements 31, 33. A multiple arrangement of cross-sectional reductions 32 is also possible in any desired combinations and embodiments.

The exemplary embodiments show possible embodiment variants of the universal closure device 1, whereby it should be noted at this point that the invention is not restricted to the embodiment variants shown in particular, but rather various different combinations of the individual embodiment variants are also possible and this variability, due to the teaching on technical procedure, lies within the ability of a person skilled in the art in this technical field. Thus all conceivable embodiment variants, which are made possible by combining individual details of the embodiment variants shown and described, are also covered by the scope of protection.

Finally, as a point of formality, it should be noted that for a better understanding of the structure of the universal closure device 1 the latter and its components have not been represented true to scale in part and/or have been enlarged and/or reduced in size.

The problem addressed by the independent solutions according to the invention can be taken from the description.

Mainly the individual embodiments shown in FIGS. 1 to 4; 5; 6; 7 can form the subject matter of independent solutions according to the invention. The objectives and solutions according to the invention relating thereto can be taken from the detailed descriptions of these figures.

| List of Reference Numerals | |
|---|---|
| 1 | closure device |
| 2 | opening |
| 3 | sample container |
| 4 | cross-section |
| 5 | longitudinal axis |
| 6 | shaft part |
| 7 | end area |
| 8 | end area |
| 9 | surface |
| 10 | head part |
| 11 | casing surface |
| 12 | sealing element |
| 13 | taper angle |
| 14 | gap |
| 15 | edge area |
| 16 | sealing element |

-continued

| List of Reference Numerals |
|---|
| 17 taper angle |
| 18 gap |
| 19 edge area |
| 20 width |
| 21 base part |
| 22 edge part |
| 23 recess |
| 24 shoulder |
| 25 central axis |
| 26 centering surface |
| 27 centering surface |
| 28 rib |
| 29 height |
| 30 cross-sectional dimension |
| 31 supporting element |
| 32 cross-sectional reduction |
| 33 supporting element |
| 34 thickness |
| 35 surface |
| 36 depression |
| 37 groove |
| 38 groove surface |
| 39 groove base |
| 40 end face |
| 41 end face |

The invention claimed is:

1. A universal closure device for openings of sample containers having different cross-sections, the closure device comprising a shaft part with an outer surface, the shaft part extending in the direction of a longitudinal axis and having end sections spaced apart from one another in the direction of the longitudinal axis, and a plurality of sealing elements arranged in the area of the outer surface of the shaft part for applying against an inner casing surface of the sample container to be closed turned towards the longitudinal axis, the sealing elements arranged on the shaft part being arranged in series in a circumferential plane and in circumferential direction of the shaft part, wherein between the sealing element and the outer surface of the shaft part at least one supporting element is arranged which extends in between, and wherein the at least one supporting element applies an approximately radially directed pressing force through at least one sealing element of the plurality of sealing elements towards the inner casing surface of the sample container to be closed.

2. The closure device as claimed in claim 1, wherein the sealing elements arranged in series in circumferential direction are arranged immediately next to one another in a starting position located outside the opening and the sealing elements arranged in series in circumferential direction contact one another in a closed position inserted into the opening of the sample container or at least overlap one another partly, in order to achieve at least a fluid-tight closure of the opening in this closed position.

3. The closure device as claimed in claim 1, wherein first sealing elements arranged in series in the circumferential direction of the shaft part are arranged immediately adjacent to the end section that is turned away from a head part of the shaft part.

4. The closure device as claimed in claim 1, wherein first sealing elements are arranged in series in the circumferential direction of the shaft part, and wherein second sealing elements arranged in series in the circumferential direction of the shaft part are arranged between the first sealing elements and a head part of the shaft part.

5. The closure device as claimed in claim 1, wherein the sealing elements arranged in series in circumferential direction are spaced apart from one another at least partly in a starting position located outside the opening.

6. The closure device as claimed in claim 1, wherein the sealing elements are formed by circular ring sections which extend over half the circumference of the shaft part.

7. The closure device as claimed in claim 1, wherein the at least one supporting element is arranged on the side of the sealing element turned towards a head part of the shaft part.

8. The closure device as claimed in claim 1, wherein the at least one supporting element has a flat profile, and wherein the longitudinal axis of the shaft part passes through the plane of the flat profile of the at least one supporting element.

9. The closure device as claimed in claim 1, wherein the at least one supporting element is configured to be rib-like or web-like and comprises a section with a cross-sectional reduction.

10. The closure device as claimed in claim 9, wherein the cross-sectional reduction is formed by a groove extending into the at least one supporting element and groove surfaces delimiting the groove laterally are inclined relative to the outer surface of the at least one supporting element.

11. The closure device as claimed in claim 1, wherein the sealing elements arranged in series in circumferential direction are arranged starting from the shaft part in the direction of a head part of the shaft part respectively in a common, truncated cone-shaped widening casing surface.

12. The closure device as claimed in claim 11, wherein a taper angle formed by the sealing elements arranged in series in circumferential direction is selected from a range with a lower limit of 70° and with an upper limit of 178°.

13. The closure device as claimed in claim 1, wherein at least one gap is formed between the sealing elements which are arranged in series in circumferential direction and are arranged immediately adjacent to one another, and wherein the at least one gap extends from an edge area of the sealing elements turnable towards the inner casing surface of the sample container in the direction of the shaft part.

14. The closure device as claimed in claim 13, wherein the at least one gap extends continuously between the outer edge area of the sealing elements to the outer surface of the shaft part.

15. The closure device as claimed in claim 13, wherein end faces of the sealing elements, which are turned towards one another and arranged adjacent to one another and which define the at least one gap, are inclined relative to the longitudinal axis in a view perpendicular to the longitudinal axis.

16. A universal closure device for openings of sample containers having different cross-sections, the closure device comprising a shaft part with an outer surface, the shaft part extending in the direction of a longitudinal axis and having end sections spaced apart from one another in the direction of the longitudinal axis, and a plurality of sealing elements arranged in the area of the outer surface of the shaft part for applying against an inner casing surface of the sample container to be closed turned towards the longitudinal axis, the sealing elements arranged on the shaft part being arranged in series in a circumferential plane and in circumferential direction of the shaft part, wherein between the sealing element and the outer surface of the shaft part at least one supporting element is arranged which extends in between, and wherein the at least one supporting element is connected to at least one sealing element of the plurality of sealing elements and is connected to the shaft part.

17. A universal closure device for openings of sample containers having different cross-sections, the closure device comprising a shaft part with an outer surface, the shaft part extending in the direction of a longitudinal axis and having end sections spaced apart from one another in the direction of the longitudinal axis, and a plurality of sealing elements arranged in the area of the outer surface of the shaft part for applying against an inner casing surface of the sample container to be closed turned towards the longitudinal axis, the sealing elements arranged on the shaft part being arranged in series in a circumferential plane and in circumferential direction of the shaft part, wherein between the sealing element and the outer surface of the shaft part at least one supporting element is arranged which extends in between, and wherein the supporting element extends in radial direction approximately to a middle between the outer surface of the shaft part and an outer edge area of the sealing element.

* * * * *